United States Patent [19]

Reddy

[11] 4,180,020

[45] Dec. 25, 1979

[54] PULSE SMOOTHING CIRCUIT FOR AN ELECTRONIC FUEL CONTROL SYSTEM

[75] Inventor: Junuthula N. Reddy, Troy, Mich.

[73] Assignee: The Bendix Corporation, Southfield, Mich.

[21] Appl. No.: 400,996

[22] Filed: Sep. 26, 1973

[51] Int. Cl.[2] ..... F02B 3/00

[52] U.S. Cl. ..... 123/32 EA; 123/32 EG

[58] Field of Search ..... 123/32 EA, 32 AE, 32 EG

[56] References Cited

U.S. PATENT DOCUMENTS

| | | | |
|---|---|---|---|
| 3,616,784 | 11/1971 | Barr | 123/32 EA |
| 3,651,343 | 3/1972 | Monpetit | 307/265 |
| 3,725,673 | 4/1973 | Frederiksen et al. | 307/242 |
| 3,727,081 | 4/1973 | Davis et al. | 123/32 EA |
| 3,727,592 | 4/1973 | Wilkinson | 123/32 EA |
| 3,763,833 | 10/1973 | Rachel | 123/32 EA |
| 3,771,502 | 11/1973 | Reddy | 123/32 EA |
| 3,786,344 | 1/1974 | Davis et al. | 323/20 |
| 3,792,693 | 2/1974 | Luchaco | 123/32 EA |
| 3,800,749 | 4/1974 | Advenler | 123/32 EA |

*Primary Examiner*—Ronald B. Cox

*Attorney, Agent, or Firm*—Anthony F. Cuoco

[57] ABSTRACT

An electronic fuel control system of the type providing metered quantities of fuel to a power producing engine in response to accurately timed electrical pulses includes circuit means for overcoming oscillations in the pulses due to a reduction in system supply voltage occurring, for example, during engine cranking. The circuit means senses when the supply voltage is below a predetermined level and thereupon is operative to eliminate the oscillations without interfering with normal system operation.

8 Claims, 5 Drawing Figures

PULSE SMOOTHING CIRCUIT FOR AN ELECTRONIC FUEL CONTROL SYSTEM

BACKGROUND OF THE INVENTION

1. Field of the Invention

This invention relates generally to electronic fuel control systems of the type which provide metered quantities of fuel to a power producing engine and particularly to means for providing said metered fuel in response to accurately timed electrical pulses. More particularly, this invention relates to means for eliminating oscillations in said pulses which occur due to a reduction in system supply voltage.

2. Description of the Prior Art

In electronic fuel control systems employing computer circuitry for generating accurately timed electrical pulses which provide metered quantities of fuel to an engine, a problem exists in that at system supply voltages below a predetermined level voltage regulation is lost. The resulting supply voltage transients are communicated to the computer circuitry and oscillations occur at the end of the pulses due to pulse regeneration, and which oscillations effect the fuel turn-off function. Prior to the present invention it has not been possible to eliminate this condition without impairing normal system operation. The present invention accomplishes this task.

SUMMARY OF THE INVENTION

The present invention contemplates circuitry for preventing oscillations from occuring at the end of fuel injection pulses generated by an electronic fuel control system for a power producing engine, and which oscillations are due to the system supply voltage falling below a predetermined level as is the case during engine cranking. When this occurs the system voltage is unregulated and a reference voltage applied at a system input follows supply voltage transients to cause pulse regeneration and hence the oscillations. The circuitry includes means for detecting when the supply voltage is below the predetermined level and for thereupon activating a circuit which eliminates the oscillations by lowering the reference voltage at the system input to prevent pulse regeneration. When the supply voltage is at the predetermined level the circuit is deactivated whereupon the system returns to normal operation.

One object of this invention is to include, in an electronic fuel control system of the type providing metered quantities of fuel to a power producing engine in response to accurately timed electrical pulses, circuit means for preventing oscillations at the end of said pulses which adversely affect the fuel cut off function.

Another object of this invention is to sense the level of the supply voltage and to activate a pulse smoothing circuit system when the sensed level falls below a predetermined level to cause said pulse oscillations, and to deactivate the circuit when the supply voltage returns to the predetermined level.

Another object of this invention is to accomplish the above without impairing system operation.

Another object of this invention is to eliminate the pulse oscillations by adjusting a reference voltage at a system input to prevent pulse regeneration.

The foregoing and other objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustration purposes only and are not to be construed as defining the limits of the invention.

DESCRIPTION OF THE INVENTION

Figure 1:
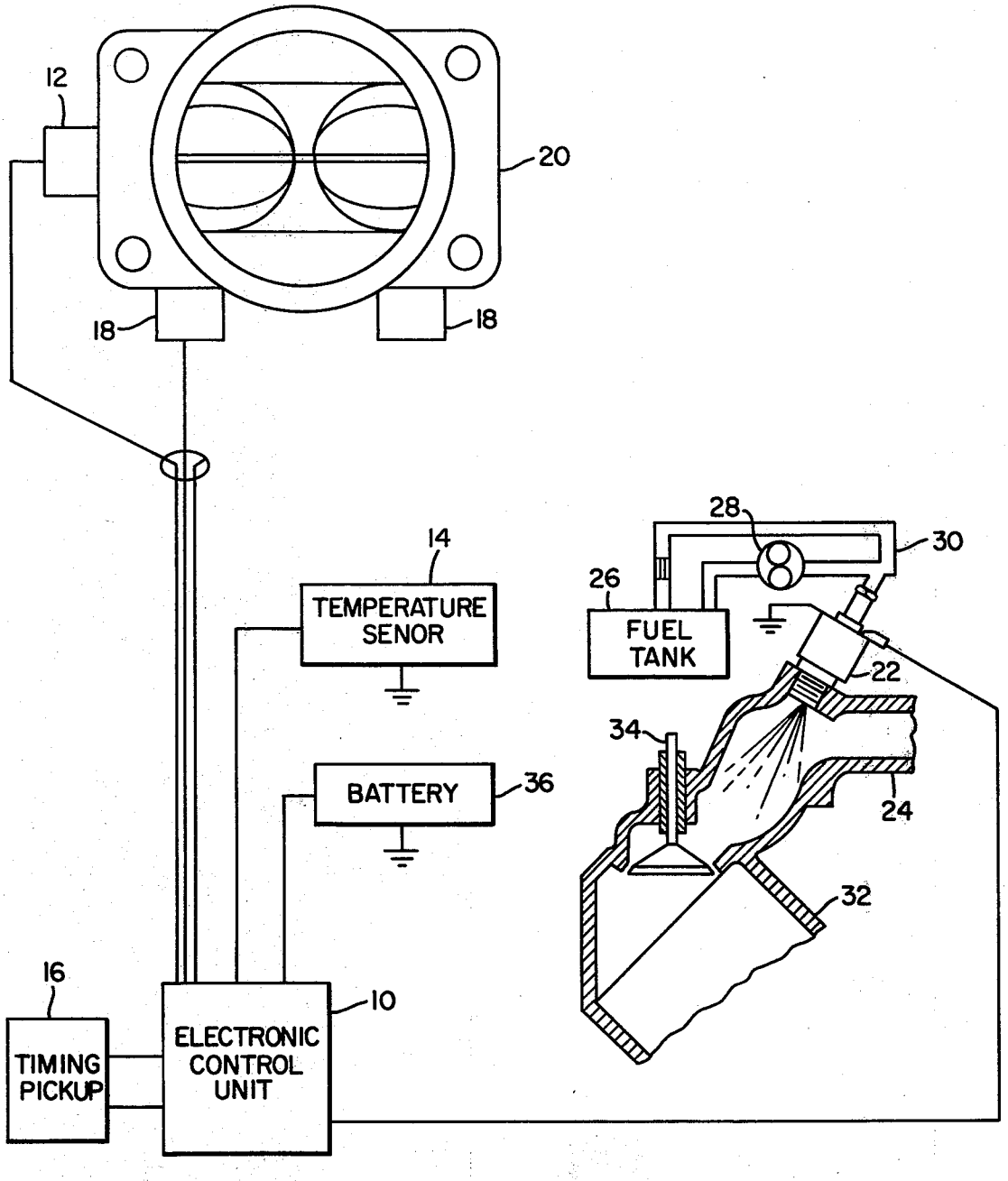
FIG. 1 is a diagrammatic representation showing an electronic fuel control system for an internal combustion engine with which the present invention may be used.

Referring now to FIG. 1, an electronic fuel control system is shown in diagrammatic form. The system is comprised of a main computing means or electronic control unit 10, a manifold pressure sensor 12, a temperature sensor 14, a timing pickup means 16 and various other sensors denoted as 18. Manifold pressure sensor 12 and the associated other sensors 18 are illustrated mounted on a throttle body 20 but it will be understood that other mounting locations are possible. The output of control unit 10 is coupled to an electromagnetic injector valve member 22 mounted in an intake manifold 24 and arranged to provide fuel from tank 26 via pumping means 28 and suitable fuel conduits 30 for delivery to a combustion chamber 32 of but one of several forms of an internal combustion engine, otherwise not shown. While injector valve member 22 is illustrated as delivering a spray of fuel toward an open intake valve 34, it will be understood that this representation is merely illustrative and that other delivery arrangements are known and utilized. Furthermore, it is well known in that art of electronic fuel control systems that control unit 10 may control an injector valve means comprising one or more injector valve members arranged to be actuated singly or in groups of varying numbers in a sequential fashion as well as simultaneously. The computing means is shown as energized by battery 36 which could be a vehicle battery and/or battery charging system as well as a separate battery.

Figure 2:
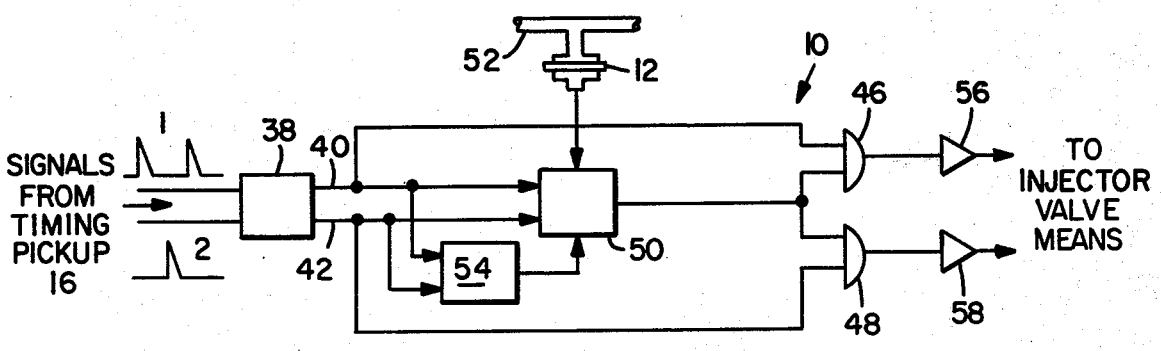
FIG. 2 is a block diagram of one form of electronic control unit used in the system of FIG. 1.

The block diagram shown in FIG. 2 illustrates control unit 10, shown generally in FIG. 1, as applied to two-group injection. In FIG. 2, there is shown a switching device 38 capable of producing alternating output signals and receiving as an input a signal or signals representative of engine crank angle as from timing pickup 16. Mechanically, timing pickup 16 may be a single-lobed cam, driven by the engine and alternately opening and closing a pair of contacts. Since this arrangement could generate spurious signals, as by contact bounce, switching device 38 will be described and discussed as a flip-flop since the flip-flop is known to produce a substantially constant level of output at one output location in response to a triggering signal which need only be a spike input as illustrated by traces 1 and 2, but may also be of longer duration, and a flip-flop may be readily made insensitive to other types of signals. Signals received at the nontriggering input will, of course, have no effect on the flip-flop. Output conductors 40 and 42 of flip-flop 38 are connected to the input of a unit 50. Output conductors 40 and 42 are also connected to the inputs of a pair of AND gates 46 and 48, with output conductor 40 being connected to one input of AND gate 46 and output conductor 42 being connected to one input of AND gate 48. Unit 50 receives, as a primary control input, signals from pressure sensor 12 indicative of an engine operating condition and, therefore, of the engine fuel requirement. Sensor 12 is here shown coupled to a manifold lead or runner 52. The actual location of sensor 12 will depend upon the dynamic characteristics of the intake manifold and throttle body. Unit 50 also receives a signal from the rpm information signalling means 54 which is arranged to also receive the triggering signals from output conductors 40, 42. The output of unit 50 is connected to a second input of each AND gate 46 and 48. The output of AND gate 46 is connected to an amplifier 56 which, in turn, supplies controlling current to the first injector group. The output of AND gate 48 is connected to an amplifier 58 which supplies controlling current to the second injector group. For the sake of simplification, the additional control inputs have been omitted.

As will be readily apparent, the presence of an output signal from flip-flop 38 will occur at one output location to the exclusion of the other. This signal will then appear at one input of only one AND gate of only one amplifier. This signal selectively designates an injector or injector group for imminent injection. For purposes of illustration, it may be assumed that the output signal of flip-flop 38 is at output location 40 so that the signal also appears at one input of AND gate 46. The signal from output 40 of flip-flop 38 also appears at unit 50 as well as the rpm information signalling means 54. Unit 50 is operative to produce an output during the passage of a predetermined amount of time. This time is determined by the values of the sensory input applied to unit 50 as well as by the input provided by rpm information signalling means 54. During this initial period of time unit 50 is providing a full-strength output signal. This signal is applied to one input of each of the AND gates 46 and 48. Because of the intrinsic nature of AND gates, an output signal is provided only while an input signal is being applied to each and every input. This then dictates that AND gate 46 will produce an output to be amplified by amplifier 56 to open the first injector group since it is receiving an injector control command from the unit 50. At the end of the time delay period, unit 50 produces a zero level signal so that the injection control command output signal is removed from the input to the AND gate 46 and the output of the AND gate 46 goes to zero, thereby allowing the first injector group to close. During the period of time the first injector group is open, a metered amount of fuel under pressure is injected by the first injector group. Depending upon the particular electronics selected, suitable amplifiers and/or inverters may be used to match obtainable signals with desired or necessary circuit responses.

Figure 3:
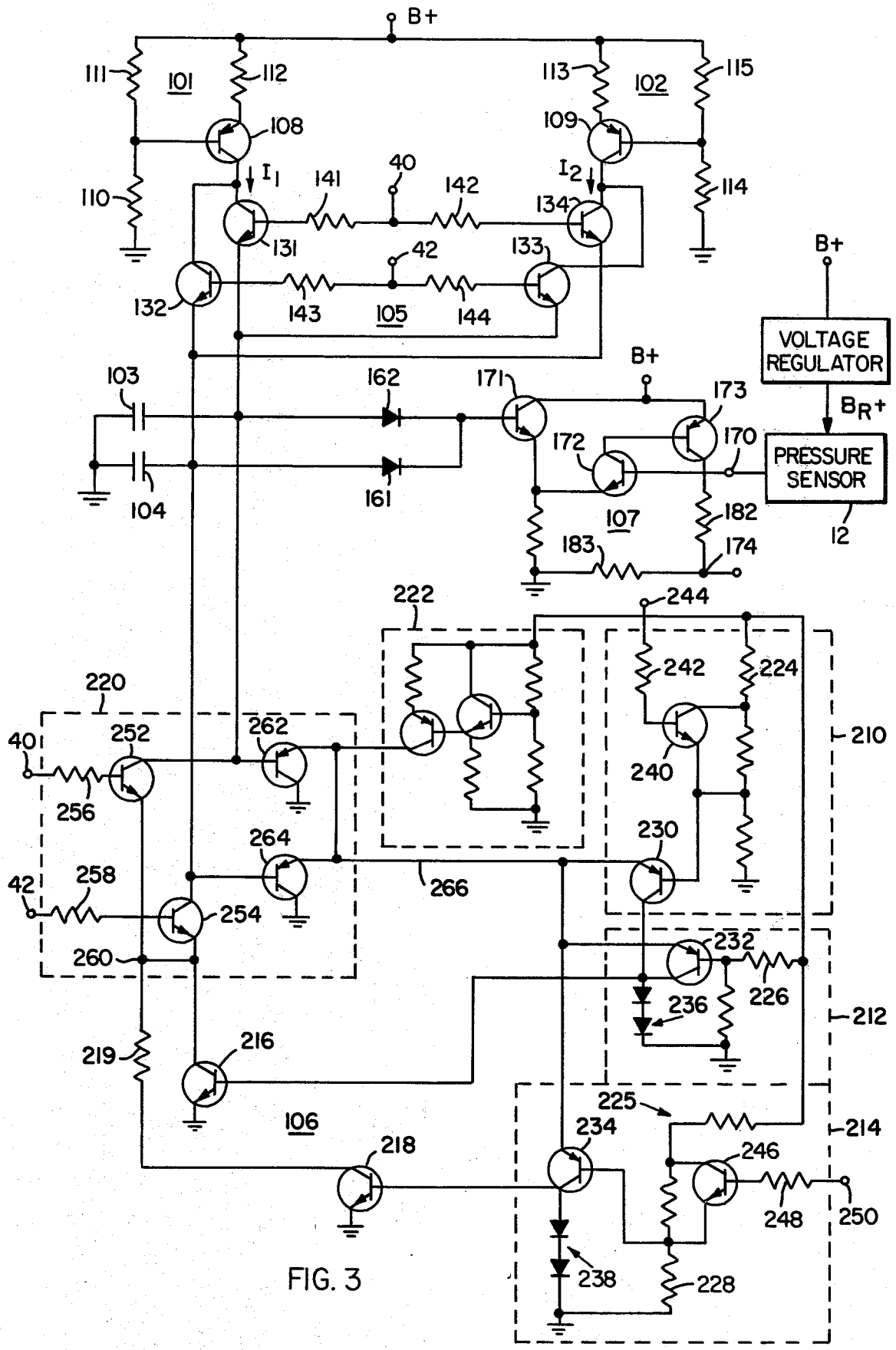
FIG. 3 is an electrical schematic diagram showing circuitry included in the electronic control unit of FIG. 2.

Referring now to FIG. 3, an electronic circuit is illustrated to satisfy the functional requirements of block 50 in the block diagram of FIG. 2. Unit 50 is comprised of a pair of current sources 101, 102 which are alternately connected to a pair of timing capacitors 103, 104 by a switching network 105 receiving triggering signals 40, 42 (FIG. 2). Also receiving triggering signals 40, 42, a network 106 controls the level of the voltage on the selected capacitors 103, 104 prior to generation of the injection command signal. Threshold establishing circuit means 107 samples the highest voltage appearing across capacitors 103, 104 and compares this value with the level established by the signal received from pressure sensor means 12 at an input terminal 170 to compute the fuel injection command signal, the same being provided at an output terminal 174. Pressure sensor 12 is powered by a source of supply potential identified as B+ applied through a voltage regulator 13 which applies a regulated voltage $B_R+$ to pressure sensor 12.

Current source 101 is comprised of transistor 108 whose base is connected to the junction of a pair of voltage dividing resistors 110, 111 and whose emitter is connected to a resistor 112. The resistors 111 and 112 are connected to the B+ supply source and resistor 110 is connected to ground. Current source 102 is similarly comprised of a transistor 109 whose base is coupled to the junction of voltage divider resistors 114, 115 and whose emitter is connected to resistor 113 which is also connected to the B+ source. This arrangement is operative to establish a known level of current flow in the collectors of transistors 108, 109, respectively. The collector of transistor 108 is then connected in parallel to the collectors of a pair of transistors 131, 132. Similarly, the collector of transistor 109 is connected in parallel to the collectors of a pair of transistors 133, 134. The bases of transistors 131 and 134 are connected together through resistances 141, 142 while the bases of transistors 132, 133 are connected by way of resistors 143, 144. The junction of resistors 141, 142 is arranged to receive the trigger signals from output 40 while the junction of resistors 143, 144 is arranged to receive the trigger signals from output 42. The emitters of transistors 131 and 133 are connected to capacitor 103 while the emitters of transistors 132 and 134 are connected to capacitor 104. This circuit is then arranged to provide current flow from current source 101 through transistor 131 to capacitor 103 and current flow from current source 102 through transistor 134 to capacitor 104 whenever a high voltage signal appears on output 40 and a low voltage signal appears on output 42. Whenever a low voltage signal is present on output 40 and a high voltage signal is present on output 42, the current from source 101 will flow through transistor 132 to capacitor 104, while the current from source 102 flows through transistor 133 to capacitor 103.

Threshold establishing circuit 107 receives a reference signal indicative of the manifold pressure at input terminal 170 and this signal is applied to the base of transistor 172. The base of transistor 171 receives by way of diodes 161, 162 the signal from the one of the capacitors 103, 104 whose accumulated charge, or voltage, is highest. As the emitters of transistors 171, 172 are coupled together, one of these transistors will be conductive depending upon which has a base at a higher voltage value. When the voltage appearing on the base of transistor 171 exceeds the voltage appearing on circuit input 170, transistor 171 will go into conduction and transistor 172 will drop out of conduction. Termination of conduction of transistor 172 will consequently terminate conduction of transistor 173. While transistor 172 was conducting, transistor 173 was also conducting and a relatively high voltage signal was present at circuit output terminal 174 due to the voltage divider action of resistors 182, 183. However, termination of conduction of transistor 173 will result in a substantially zero or ground level signal appearing at output terminal 174 due to the lack of current flow through resistors 182, 183 so as to provide output pulses at output terminal 174. These output pulses are applied to OR gates 46, 48 in FIG. 2 to constitute a fuel injection command.

The timing capacitor discharging and initial charge controlling circuitry 106 is comprised of a plurality of reference level establishing means 210, 212, and 214, a pair of discharging means 216, 218, switching means 220 and a current source means 222. The reference level establishing means 210, 212, and 214 are connected to the source of potential indicated as B+ and are comprised of voltage divider means 224, 226, and 228, respectively, and voltage signal communicating transistor means 230, 232, and 234, respectively. The voltage communicating transistor means 230, 232 and 234 are arranged to have their bases communicated to a portion of the voltage divider means so that a known level of voltage may appear thereon and their emitters are connected to a common point. The collectors of transistors 230 and 232 are coupled together and are connected to ground through a diode means 236 while the collector of transistor 234 is communicated to ground through a separate diode means 238. The collector/diode junction of the transistors 230, 232 and diode means 236 is connected to the discharging means 216 while the collector/diode junction of transistor 234 and diode means 238 is connected to the discharging means 218.

Reference level establishing means 210 further includes a transistor 240 whose collector and emitter terminals are arranged to short-circuit at least a portion of the voltage divider means 224 when the transistor is in conduction. The base of transistor 240 is coupled to resistance 242 which is in turn coupled to external terminal 244. Similarly, reference level establishing means 214 includes a transistor 246 arranged in short-circuit relationship to at least a portion of the voltage divider means 228. Resistance 248 appears in the base circuit 246 and thus is connected to external terminal 250.

Energy dissipating means 216 and 218 are here illustrated as transistor elements having their emitter electrodes connected to ground and their base electrodes connected to the collectors, respectively, of transistors 232 and 234. The collector of transistor 216 is coupled to switching means 220 while the collector of transistor 218 is coupled to resistor 219 which is, in turn, coupled to switching means 220.

Switching means 220 is comprised of a pair of transistors 252, 254 having resistors 256 and 258 in their base circuits. Resistor 256 is further connected to terminal 40 and resistor 258 is connected to terminal 42. The emitters of the transistors 252 and 254 are coupled together at a common circuit connection junction 260 and this common circuit connection is, in turn, connected to energy dissipating means 216 and 218. In the illustrated embodiment this is accomplished by connecting the collector of transistor 216 to common junction 260 and the collector of transistor 218 through further resistor 219 which is then connected to common junction 260. The collector of each of the switching transistors 252, 254 is coupled to the base of a regulating transistor 262, 264 respectively and each of these collector-base connections is connected to one of the two timing capacitors 103, 104 so that switching transistor 252 is coupled to regulating transistor 262 and also to timing capacitor 103, while switching transistor 254 is coupled to regulating transistor 264 and also to timing capacitor 104.

The regulating transistors 262, 264 and the controlled regulation transistors 230, 232 and 234 are intercoupled in a common-emitter configuration by common circuit connection 266 coupled directly to each of the emitters of the five above enumerated transistors. Each of the five transistors is illustrated as being a PNP transistor, with the regulating transistors 262, 264 having their collectors connected to ground and the controlled regulation transistors 230, 232 and 234 having their collectors connected to ground through a diode means which is here illustrated as the pairs of diodes identified as 236 and 238.

Current source means 222, which is herein illustrated as a conventional transistorized current source, is operative to provide a known level of current through the common circuit connection 266. As is known in the art, the configuration comprising transistors, 230, 232, 234, 262, and 264, each having a voltage signal applied to the base thereof, will have only those transistors in conduction which have the lowest identical base voltage. In the event that there is a single base residing at a lowest potential, that transistor and only that transistor will be in conduction and all others will be turned off due to the fact that the common emitters will be at a potential which is one PN junction above the value of the lowest base voltage, and this value will be insufficient to forward bias any other emitter-base junctions.

The circuit as illustrated is arranged to provide the lowest voltage potential at the base of controlled regulation transistor 232 when signals are present on each of the input terminals 244, 250. In such a configuration, and assuming a varying voltage appearing across both timing capacitors 103, 104, whenever the potential appearing across the appropriate one of the timing capacitors becomes identical with the voltage appearing on the base of the controlled regulation transistor 232, the regulating transistor which is coupled to the appropriate timing capacitor will begin to conduct so as to maintain that timing capacitor at the potential then appearing on the base of transistor 232. By suitably arranging the various resistor values within the voltage divider resistor networks 224, 226 and 228, it can be arranged that the base of the controlled regulation transistor 232 will be at a value lower than the base of either of controlled regulation resistors 230, 234 while the shorting transistors 240 and 246 are switched on and will be at a higher value than at least one of the bases of controlled regulation transistors 230, 234 while either of shorting transistors 240 and 246 is not conducting. Furthermore, it can be arranged that the lowest voltage appearing at any of the three bases of transistors 230, 232, 234 may be sequentially varied by controlling the conductive states of the shorting transistors through the signals applied to the external terminals 244, 250.

Figure 5:
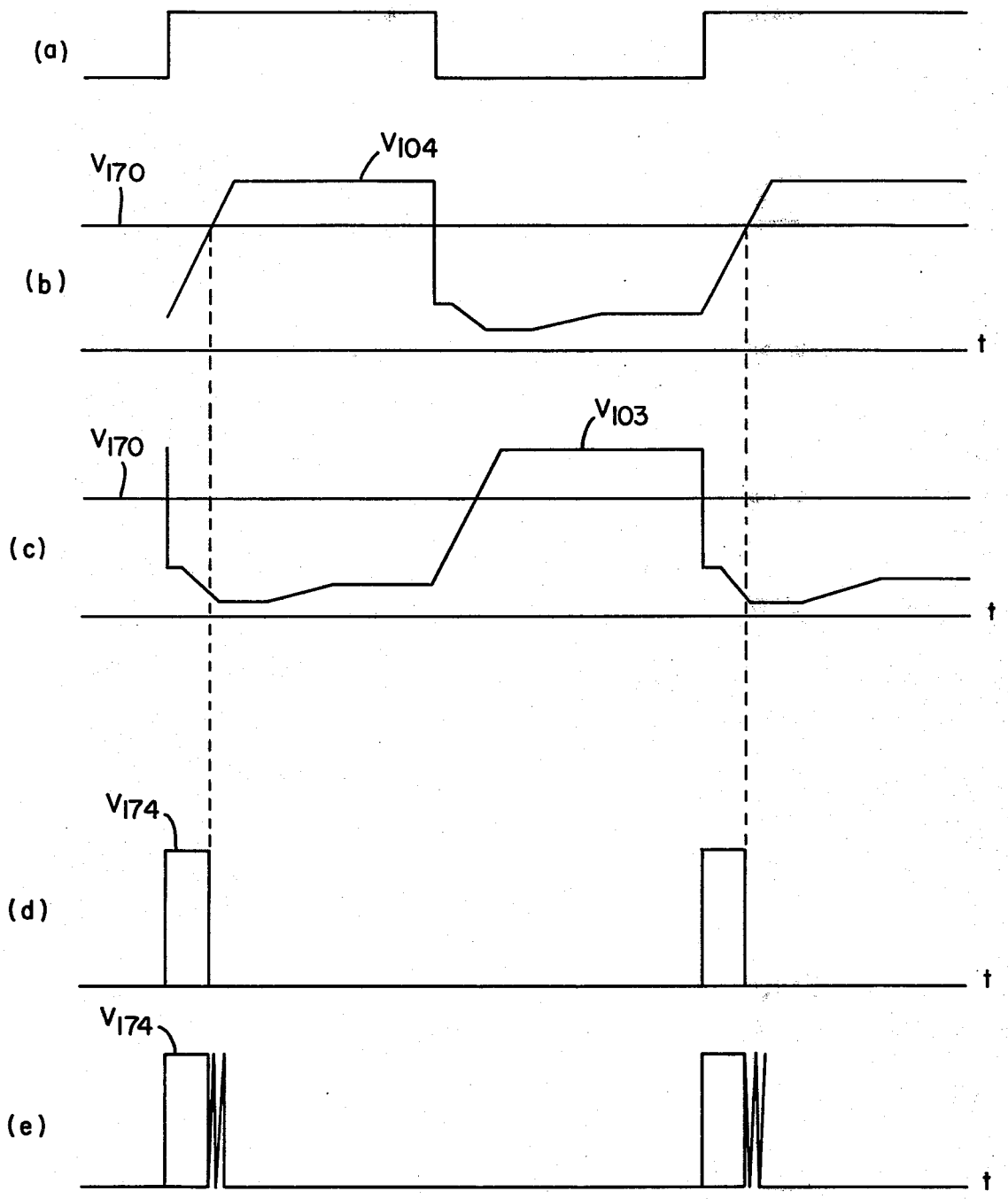
FIG. 5 is a graphical representation showing voltage waveforms illustrative of the operation of the invention.

Referring now to FIGS. 2 and 3 and 5, receipt of a triggering signal on the appropriate input lead will result in the signals on output conductors 40 and 42 of flip-flop 38 as illustrated in FIG. 5(*a*). That is to say, a relatively high signal will appear on conductor 40 and a ground or zero level signal will appear on conductor 42. The zero level signal received on lead 42, when applied to the appropriate terminals of the circuit of FIG. 3, will be operative to turn off the various transistors which are in communication through their control electrode with the conductor 42 (for example transistors 132, 133, and 254). The presence of the high voltage signal on lead 40 will be operative to turn on those transistors whose control electrodes are in communication with the lead 40 (for example transistors 131, 134 and 252). Thus, the current identified as $I_1$ in FIG. 3 will be applied to the timing capacitor 103 while the current identified as $I_2$ will be communicated to the timing capacitor 104. Also, timing capacitor 103 will be connected by way of transistor 262 to the common circuit connection 260 and timing capacitor 104 will be connected by way of transistor 264 to the common circuit connection.

The preceding cycle of operation will have provided the timing capacitor 103 with a relatively high voltage at the instant of switching. This voltage is communicated to the base transistor 262 while the voltage then appearing on timing capacitor 104 which is some lower value is communicated to the base of transistor 264. Immediately following a triggering event, a current will be flowing through diode means 236 from the reference level establishing means 210. The presence of this current flow will be operative to turn energy dissipating transistor 216 on. This transistor, being turned on and communicated to the common circuit point 260, will be operative to dump the voltage then appearing on timing capacitor 103 and the voltage on the base of transistor 262 will drop. As this voltage approaches the voltage appearing on the base of the one transistors of the pair of transistors 230 which is providing the current flow through the diode means 236, this transistor will begin to turn off and transistor 262 will begin to turn on due to their common emitter configuration. This switching off of transistor 230 will result in the switching off of transistor 216 and the voltage appearing on the timing capacitor 103, for example, will then be regulated to the lowest voltage then appearing on the bases of transistors 230, 232, and 234. Under these conditions pulses will be generated at output terminal 174 as illustrated in FIG. 5(*d*).

It will now be understood that the voltage applied to pressure sensor 12 ($B_R+$) will be regulated as long as B+ supply potential is within a predetermined range, which may be eleven to eighteen volts, for purposes of illustration. When the B+ supply drops below eleven volts, as is generally the case during engine cranking, this voltage regulation is lost and the reference voltage at system input terminal 170 follows B+ supply potential transients. This results in the appearance of oscillations at the end of the pulses provided at output terminal 174, said oscillations being illustrated in FIG. 5(*e*). The oscillations occur because the voltage on capacitors 103, 104 does not change instantaneously while the voltage at terminal 170 does.

In this connection it is noted that the generation of pulses at output terminal 174 occurs from the time flip-flop 38 changes state until the voltage on capacitor 103, 104 rises above the reference signal level at input terminal 170. When the pulses are terminated (i. e., as soon as the voltage on one of the capacitors is slightly above the reference level) fuel injectors 22 are commanded to close. This command causes the current flowing through the injectors to stop immediately, and which condition causes a step change in the supply voltage. Since voltage regulation is lost at low supply voltages, the step change in supply voltage appears as a step change in the reference signal at terminal 170. This results in a regeneration of the pulses at terminal 174 since, as a result of the step change in the reference voltage at terminal 170, transistor 172 is rendered conductive, i.e., the voltage at the base of transistor 172 is higher than the voltage at the base of transistor 171. Thus, when supply voltage B+ is above eleven volts, regulated supply voltage $B_R+$ is maintained at, for example, nine and a half volts. When B+ drops below eleven volts $B_R+$ also drops. Under these conditions B+ fluctuations are transmitted to pressure sensor 12 so that the output of the pressure sensor follows the fluctuations.

Pulse smoothing circuitry according to the invention overcomes the aforenoted oscillations by detecting the condition wherein the supply voltage is below a predetermined value and thereupon eliminating the oscillations by preventing regeneration of the pulses at output terminal 174 by lowering the reference voltage at input terminal 170 as soon as the voltage on capacitors 103 and 104 rises above the reference level.

Figure 4:
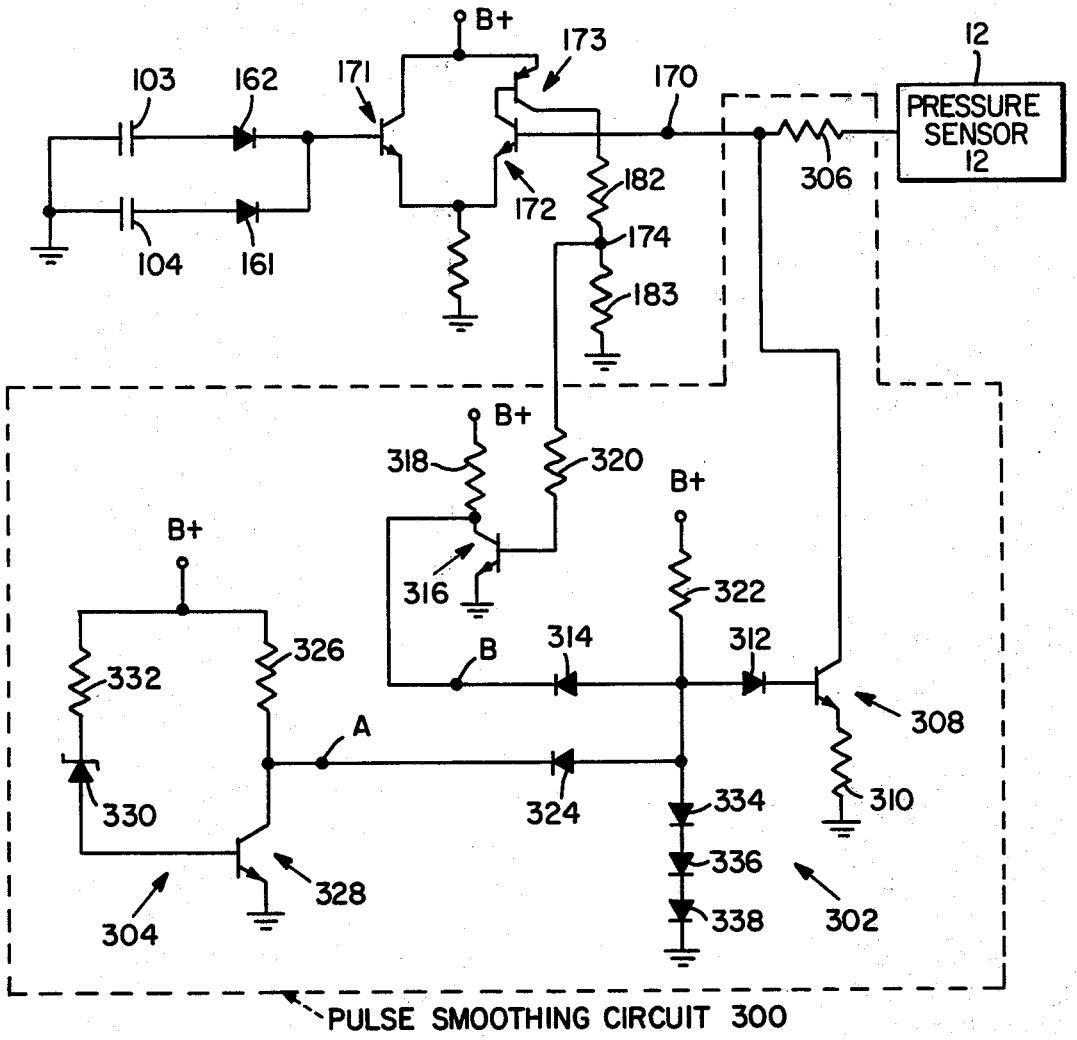
FIG. 4 is an electrical schematic diagram showing the invention incorporated in the circuitry of FIG. 3.

Thus, with reference to FIG. 4, pulse smoothing circuit 300 is shown in conjunction with as much of the circuitry of FIG. 3 as is necessary to describe the operation of the pulse smoothing circuit. Circuit 300 includes a circuit means 302 and switching means 304. Circuit means 302 includes a resistor 306 connecting pressure sensor 12 to system input terminal 170. A transistor 308 has a collector connected intermediate input terminal 170 and resistor 306, an emitter grounded through a resistor 310 and a base connected through diodes 312 and 314 to the collector of a transistor 316. Transistor 316 has a grounded emitter and the collector is connected through a resistor 318 to B+ supply potential source. The base of terminal 316 is connected through resistor 320 to system output terminal 174.

B+ supply potential source is connected through a resistor 322, grounded through diodes 334, 336, 338, to a point intermediate diodes 312 and 314 and is connected through a diode 324 to a point intermediate a resistor 326 and the collector of a transistor 328 included in switching means 304. Transistor 328 includes a grounded emitter and a base connected to a zener diode 330. B+ supply potential source is connected to resistor 326 and is connected to zener diode 330 through a resistor 332.

The relationship between the voltage at input terminal 170 and the voltages on capacitors 104, 103 is shown in FIG. 5, (*b*) and (*c*), respectively. Under normal operating conditions, that is with B+ supply potential at about fourteen volts, zener diode 330 will be conductive, point A in FIG. 4 will be at about 0.1 volts, and circuit means 302 will be inhibited. When B+ supply potential drops below a predetermined level which may be eleven volts as when the engine is cranked, zener diode 330 is rendered nonconductive and turns off the base current to transistor 328 so that the voltage at circuit point A goes to the supply potential. Diodes 312, 314 and 324 form an AND gate, both inputs to which must be high to activate circuit means 302.

The voltage at circuit point B in FIG. 4 goes high (to the supply voltage) when the ramp of capacitors 103 or 104 rises above the reference voltage at input terminal 170. When this takes place, and when the voltage at point A in FIG. 4 is high, circuit 302 is activated and pulls a current I, as determined by resistor 310, through resistor 306. This has the effect of lowering the voltage at input terminal 170 by the value $R_{306}$X I and inhibits the regeneration of pulses at system output terminal 174. In other words, when both inputs to the gate formed by diodes 312, 314, 324 are high, transistor 308 is enabled to pull down the voltage at terminal 170. Circuit means 302 is enabled only when B+ supply voltage is lower than a reference determined by zener diode 330 with, at the same time, the output pulses being present at terminal 174 when the voltage on capacitors 103, 104 exceeds the reference at input terminal 170. It will be understood that the value of resistor 306 is chosen so as to inhibit regeneration of the pulses at the worst case conditions, i.e., resistor 306 and the current therethrough are sized so that their product exceeds the worst case transient conditions at terminal 170.

It will be seen from the aforenoted description of the invention that switching means 304 can readily be used to switch circuit means 302 in or out of the system as a function of B+ supply voltage. Thus the circuit means is operational only when the B+ supply voltage is below a predetermined value to inhibit regeneration of pulses at output terminal 174 and to thus eliminate undesirable pulse oscillations. The switching is accomplished without interferring with the normal operation of the rest of the system.

Although but a single embodiment of the invention has been illustrated and described in detail, it is to be expressly understood that the invention is not limited thereto. Various changes may also be made in the design and arrangement of the parts without departing from the spirit and scope of the invention as the same will now be understood by those skilled in the art.

What is claimed is:

1. In a power producing engine fuel control system of the type driven by the voltage from a system voltage supply source and having sensor means responsive to engine conditions operative to provide signals indicative of engine operating parameters one of which is applied as a reference signal, including means responsive to engine triggering events, for providing accurately timed electrical signals for delivering metered quantities of fuel to the engine, the improvement comprising:

means connected to the system supply source for sensing the level of the voltage therefrom;

means connected to the system and to the voltage level sensing means for adjusting the level of the reference signal when the supply voltage is below a predetermined level to prevent regeneration of the fuel delivery signals; and switching means for switching the reference signal level adjusting means in and out of the system as a function of the supply voltage and without interfering with the operation of the system.

2. The improvement as described by claim 1, wherein:

the means connected to the system supply source for sensing the level of the voltage therefrom includes a current flow control device rendered nonconductive when the supply voltage is below the predetermined level and rendered conductive when the supply voltage is above said level; and the means connected to the system and to the voltage level sensing means for adjusting the level of the reference signal when the supply voltage is below a predetermined level to prevent regeneration of the fuel delivery signals is activated when the current flow control device is nonconductive and inactivated when said device is conductive.

3. The improvement as described by claim 2, wherein:

the means connected to the system supply source for sensing the level of the voltage therefrom provides a first high level output when the current flow control device is nonconductive; and the means connected to the system and to the voltage level sensing means for adjusting the level of the reference signal when the supply voltage is below a predetermined level to prevent regeneration of the fuel delivery signals includes means for providing a second high level output when the fuel delivery signals are not present and gating means responsive to said first and second high level outputs for providing an output to prevent signal regeneration.

4. The improvement as described by claim 3, wherein:

the first and second high level outputs are at the supply voltage level.

5. The improvement as described by claim 3, wherein:

the means connected to the system and to the voltage level sensing means for adjusting the level of the reference signal when the supply voltage is below a predetermined level to prevent regeneration of the fuel delivery signals includes resistor means; and said resistor means being sized to prevent signal regeneration at predetermined worst case conditions in response to the gating means output signal.

6. In a power producing engine fuel control system of the type driven by the voltage from a system supply source and having sensor means responsive to engine conditions operative to provide signals indicative of engine operating parameters one of which is applied as a reference signal including means responsive to engine triggering events, for providing accurately timed electrical signals for delivering metered quantities of fuel to the engine, the improvement comprising:

circuit means for adjusting the level of the reference signal means to prevent regeneration of the fuel delivery signals; and switching means for switching the circuit in and out of the system as a function of the supply voltage and without interfering with the operation of the system.

7. The improvement as described by claim 6, wherein:

the switching means switches the circuit in the system when the supply voltage is below a predetermined level.

8. The improvement as described by claim 6, wherein:

the circuit means includes means for adjusting the level of reference signal means to prevent regeneration of the fuel delivery signals under predetermined worst case conditions.

* * * * *